US006059658A

United States Patent [19]

Mangano et al.

[11] Patent Number: 6,059,658

[45] **Date of Patent: *May 9, 2000**

[54] SPINNING WHEEL GAME AND DEVICE THEREFOR

[76] Inventors: Barbara Mangano; Mark R. Casburn, both of 3100 E. Kingspoint, Las Vegas, Nev. 89120

[ * ] Notice: This patent is subject to a terminal disclaimer.

[21] Appl. No.: 09/165,480

[22] Filed: Oct. 2, 1998

Related U.S. Application Data

[63] Continuation-in-part of application No. 08/746,605, Nov. 13, 1996, Pat. No. 5,839,955.

[51] Int. Cl.[7] ..... A63F 9/24

[52] U.S. Cl. ..... 463/16

[58] Field of Search ..... 463/12, 13, 16, 463/17, 18, 19, 20, 25; 273/142 R, 142 H, 142 HA, 142 J, 292, 294

[56] References Cited

U.S. PATENT DOCUMENTS

| | | | |
|---|---|---|---|
| 1,892,664 | 1/1933 | Eyles . | |
| 2,246,383 | 6/1941 | Rice . | |
| 2,565,557 | 8/1951 | Guimond . | |
| 3,941,389 | 3/1976 | Guimond . | |
| 4,492,378 | 1/1985 | Williams . | |
| 5,188,363 | 2/1993 | Marnell et al. . | |
| 5,332,219 | 7/1994 | Marnell, II et al. | 463/13 |
| 5,496,038 | 3/1996 | Kangsaharaks . | |
| 5,553,851 | 9/1996 | Malavazos et al. . | |
| 5,607,162 | 3/1997 | Boylan et al. . | |

FOREIGN PATENT DOCUMENTS 285252 of 1992 Japan .

*Primary Examiner*—George Manuel
*Attorney, Agent, or Firm*—Philip J. Anderson; Quirk & Tratos

[57] ABSTRACT

A device and method for playing a primary and a secondary, bonus game are set forth which includes a primary game device and a secondary game device having a display having five concentrically arranged wheels each having an indicia of an Ace, King, Queen, Jack, Ten and a wild symbol. In response to receiving a preselected bonus outcome during play of the primary game device the secondary game device is actuated to rotate the wheels and randomly present an indicia from each wheel at a payline as an secondary outcome. The outcome of the secondary game device can be used as an additional award or to multiply the award for the bonus outcome in the primary game.

24 Claims, 7 Drawing Sheets

2
40
28a
26
26
10
ACE
KING
QUEEN
JACK
TEN
WILD
ACE
KING
QUEEN
JACK
TEN
WILD
ACE
KING
QUEEN
JACK
TEN
WILD 40
28a
10
26
26
ACE
KING
QUEEN
JACK
TEN
WILD
28f
28b
18a
12
18b
18e
28e
28c
18c
26
44
28d
18d
118
PAYTABLE
100
102b
102c
BAR
BAR
120
120a
104
BAR
BAR
108
CREDITS
150
106
116
114
112
110

SPINNING WHEEL GAME AND DEVICE THEREFOR

CROSS REFERENCE TO RELATED APPLICATION

This application is a continuation-in-part application of application Ser. No. 08/746,605 filed Nov. 13, 1996 U.S. Pat. No. 5,839,955.

FIELD OF THE INVENTION

The present invention relates to games and more particularly to games of chance and methods therefore.

BACKGROUND OF THE INVENTION

Games of chance are fun and exciting for players to play for amusement. The excitement is enhanced when the game is played in a casino setting whereat players can wager upon an anticipated outcome of the game. If the anticipated outcome occurs, the wager is won and the player receives a prize. If the outcome wagered upon does not occur, the wager is lost.

One such game found in many casinos is referred to as the Wheel of Fortune game. Typically, such Wheel of Fortune games are based upon the use of a large wheel or spinner which is rotated by an employee of the casino and gradually slows until it stops to register one of a plurality of spaces around its periphery at a payline. The peripheral spaces are marked, often with representations of denominations of money, to indicate the difference between the various outcomes which can be wagered upon. For example, different denominations of dollar bills, five dollar bills, ten dollar bills, twenty dollar bills and one or two joker or logo indicia are distributed about the periphery in different concentrations. A wagering board, having like symbols of the denominations, provides a place for the players to make wagers. Payoffs are determined by the concentrations of the symbols, e.g. dollar bills, in relation to the overall number of peripheral spaces. Thus, a player may place a wager on a dollar bill and twenty dollar bill anticipating that the Wheel of Fortune game will register when it stops at the payline a like dollar bill or twenty dollar bill. Payoffs may be, for example, 1 to 1 for a dollar bill symbol wager and 20 to 1 for a twenty dollar symbol wager.

The Wheel of Fortune game, while providing fun and excitement, has several drawbacks. One drawback is that typically the payoffs offered do not exceed 40 to 1. Therefore, large jackpots can not be awarded. The offering of a large jackpot contributes to the excitement of the game for players and bystanders alike.

Furthermore, the Wheel of Fortune game does not proactivley induce passers by or bystanders to play the game. Quite often, for this reason, the Wheel of Fortune game in casinos is often tucked away at a location near for example, a restaurant to garner casual play as passers by wager their pocket change. The simplicity of the game, the lack of proactive enticement of players and the failure to offer large jackpots has impacted the ability of the Wheel of Fortune game to compete with other games.

It has also been known to provide a secondary or "bonus" game with a primary game such as an electromechanical or video, multi-reel, slot machine. One such machine has a secondary game including a rotating wheel divided into sectors, each sector identifying a prize such as different amounts of money. When the player obtains a certain outcome such as a specified symbol in the primary game, the secondary game is activated causing the wheel to rotate to select a sector and the corresponding prize of that sector is awarded.

A drawback of such games is that the secondary game does not proactively attract players to the game by offering an enticing secondary game. Further, a secondary game offering outcomes relating to Poker hands is not provided. It would be advantageous to provide a device having a secondary or bonus game which overcomes these drawbacks.

SUMMARY OF THE INVENTION

There is, therefore, provided according to the present invention, a game suitable for casino or non-casino play which offers a jackpot and which provides proactive enticement of players to increase excitement of the game and method provided herein.

Accordingly, the present invention is directed to a device for playing a game of chance having a primary game device for selecting winning and losing primary outcomes. At least one primary game outcome is designated as a bonus outcome. The primary game device may be a multi-reel slot machine. Means are provided for the player to register a wager to play the primary game. Winning outcomes of the primary game result in a payout to the player, i.e. dispensing of coins or token in the amount won or the recording of game credits available for play.

A secondary game includes a display representing five areas, each area bearing a representation of one of an Ace, King, Queen, Jack, Ten and a Wild symbol. Preferably five concentric wheels are provided, each having the five areas and representations. Means are provided for randomly selecting an outcome of the secondary game in response to the player obtaining a bonus outcome in the primary game. The outcome may be produced by displaying the wheels as rotating to locate an area of each ring at a designated payline. Depending upon the outcome of the secondary game, the player receives an award. The secondary outcomes are preferably in the nature of: (i) Ace, King, Queen, Jack and Ten in sequence, (ii) five Wild symbols, (iii) five of a kind, (iv) four of a kind, (v) a full-house, (vi) a straight, (vii) three of a kind, (viii) two pair and (ix) a pair.

The wheels including the areas with the representations may be mechanically driven or may be represented in a video display.

To proactively entice players, the payline can be illuminated in one or more colors and color sequences. When an outcome combination is selected, the corresponding wagering area is illuminated to identify to the players which combination has occurred. The illumination of the selected combination of the payline is visible from distant locations and hence proactively entices players to participate in the game.

Still further, upon a selected outcome, e.g. straight, or better, means for playing music can be initiated. The combined effect of the lights and music entices players to play the game.

As can be appreciated, the game according to the present invention can provide for a large bonus jackpot for certain secondary game outcome combinations. Furthermore, the use of the five concentric areas contributes to the excitement of the game as the players and bystanders watch the interplay of the areas as the indicia are selected. Furthermore, the feature of illuminated the payline and wagering area corresponding to the outcome and the play of music, further attracts players to play the game.

BRIEF DESCRIPTION OF THE DRAWINGS

These and other features and advantages will become appreciated as the same becomes better understood with reference to the specification claims and drawings wherein:

DESCRIPTION

Figure 1:
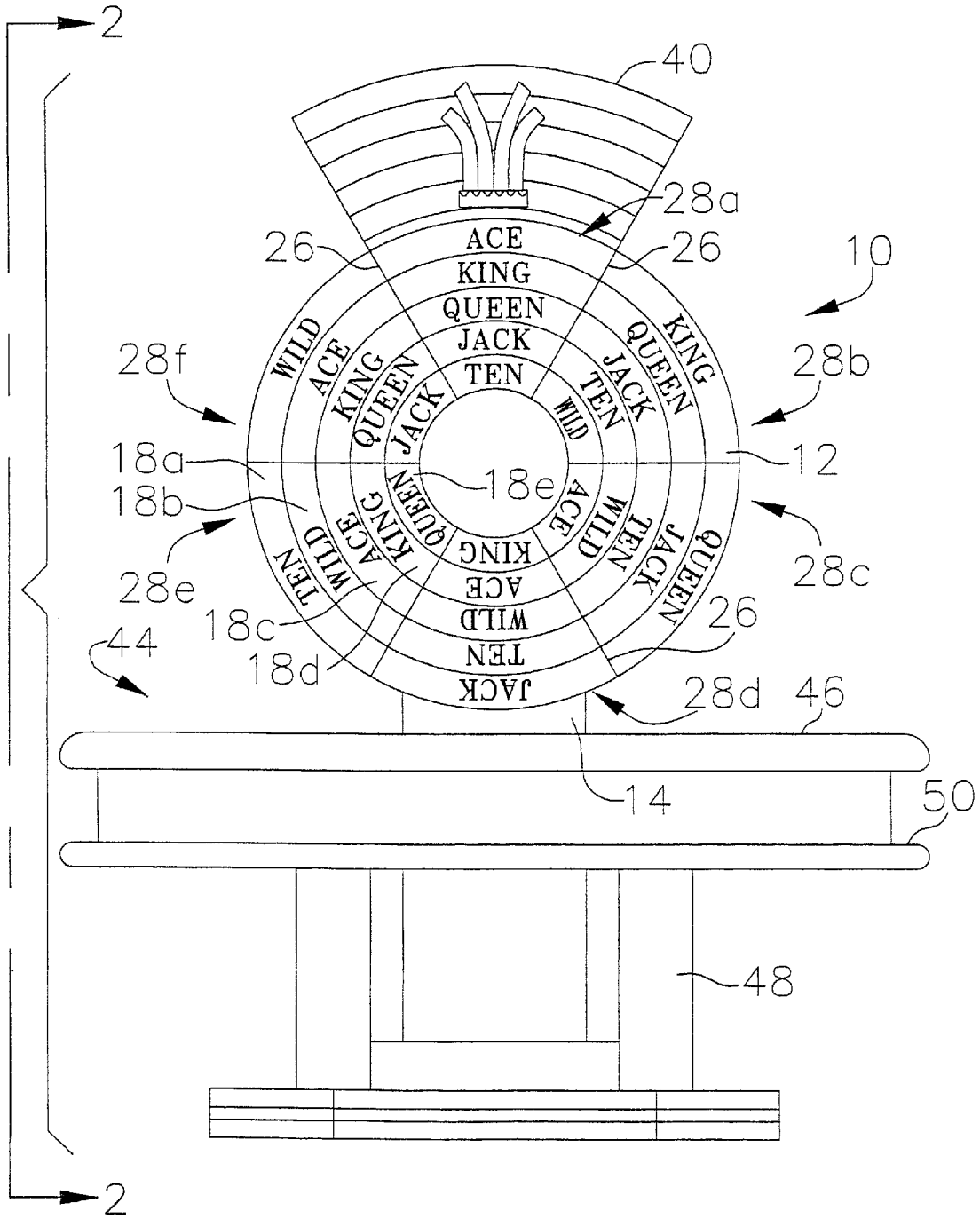
FIG. 1 is a front view of a device for playing the game according to the present invention.
Figure 2:
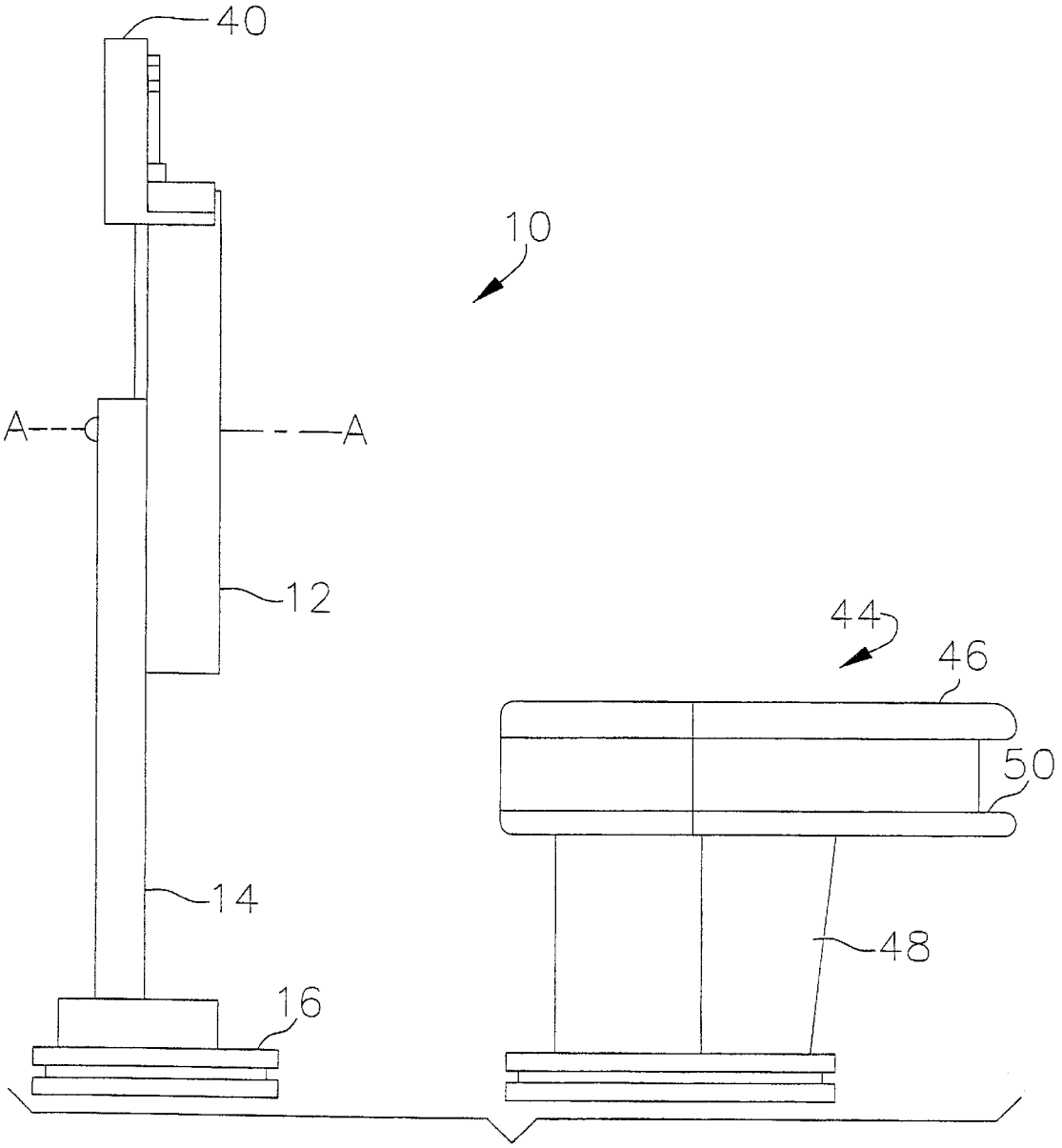
FIG. 2 is a side view of the device of FIG. 1
Figure 3:
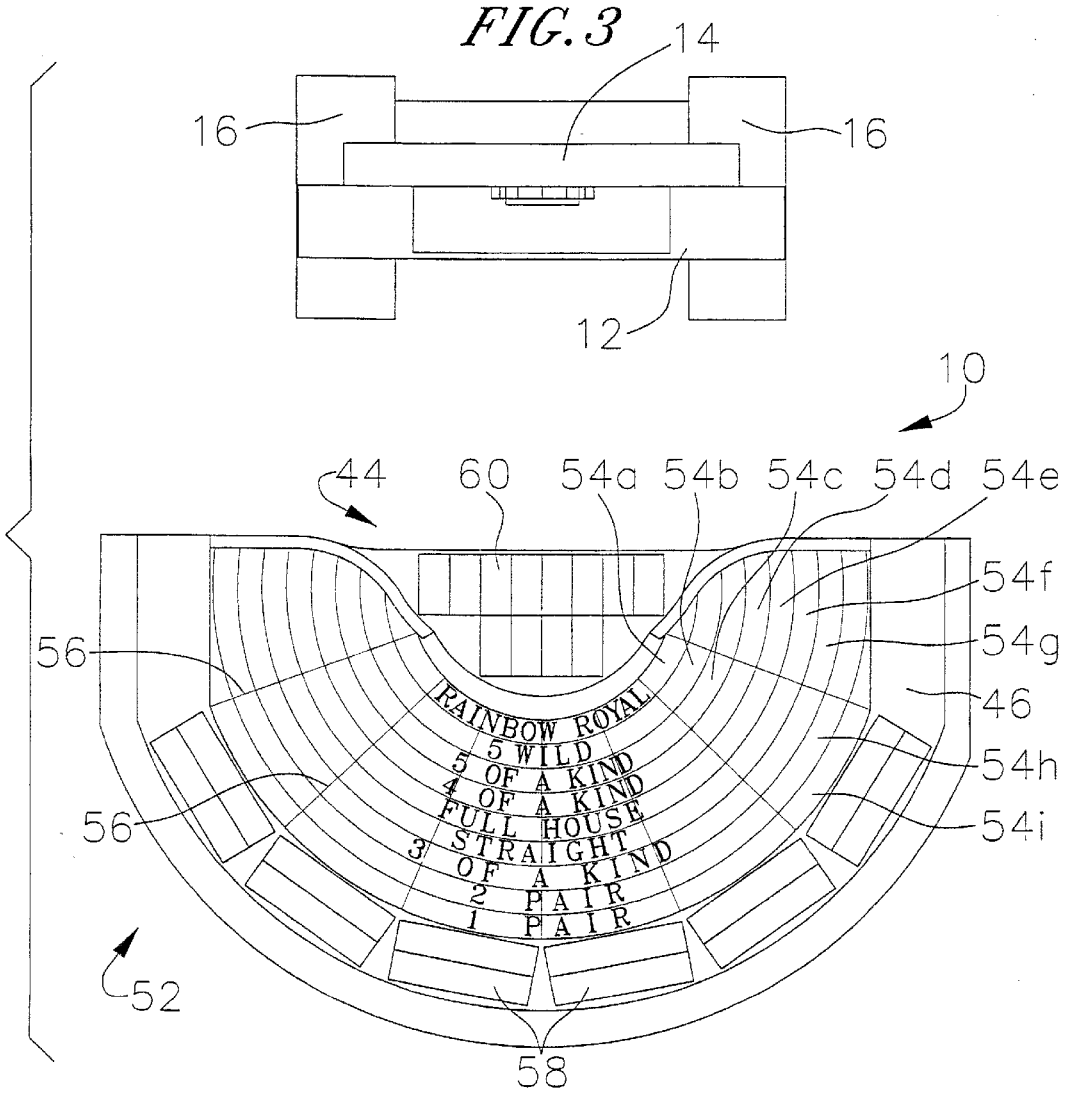
FIG. 3 is a top view of the device of FIG. 1 illustrating the wagering area.

Turning to the drawings, FIGS. 1 through 3 illustrate a mechanical embodiment of a device 10 according to the present invention. The device 10 includes a display 12 supported above the ground by a pedestal 14. As illustrated, the display 12 may be circular and have a diameter of 5 feet or more to be visible from a distance to entice players to approach and play the game using the device 10. To support the upstanding orientation of the pedestal 14 and display 12, the pedestal has a pair of spaced feet 16 which rest on the ground.

The display 12 has five concentrically disposed wheels 18*a–e* each disposed for independent rotation relative to the pedestal 14 about a common axis shown as axis A. For this purpose, each wheel 18*a–e* may be journaled to a common axle (not shown) or may be independently journaled as illustrated in FIG. 4.

Figure 4:
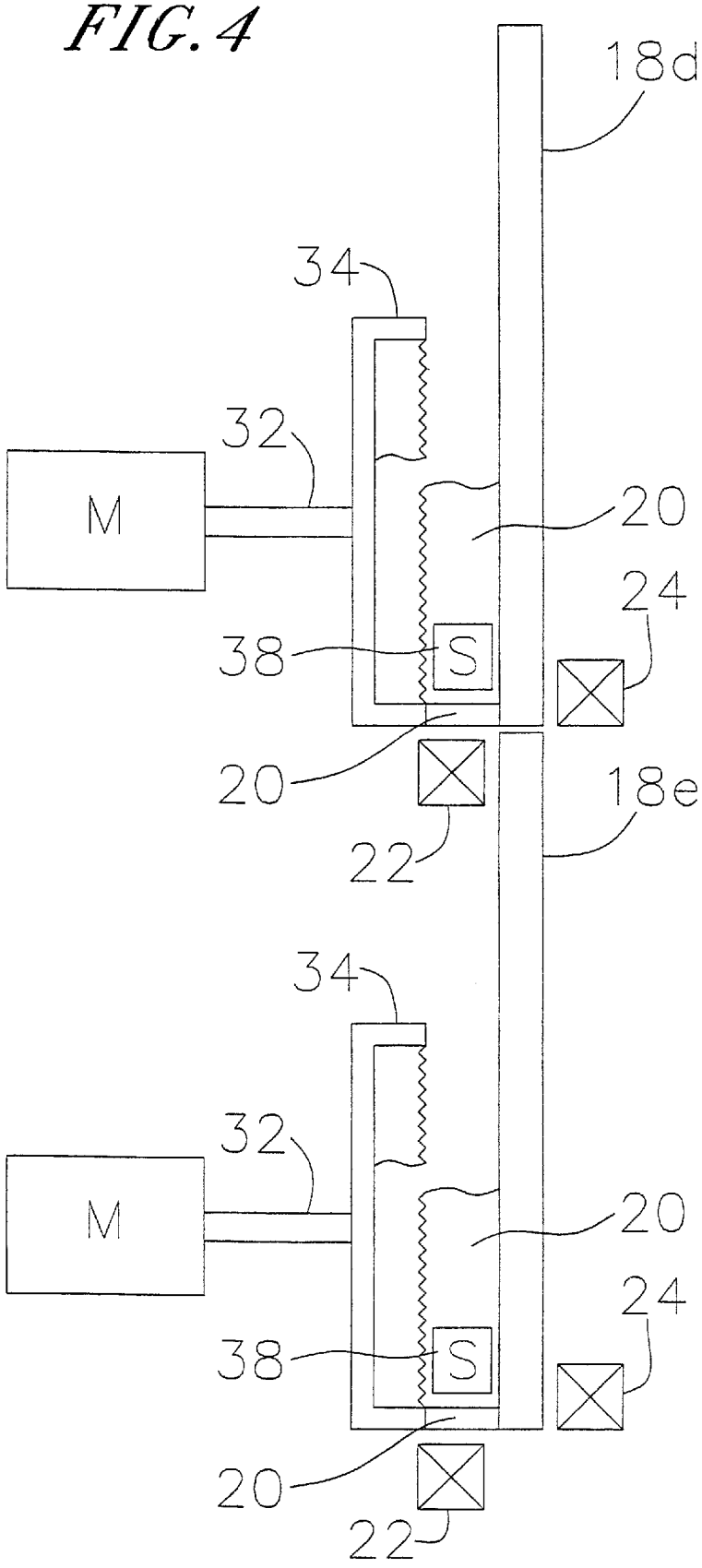
FIG. 4 is a partial section view of a portion of the device of FIG. 1 illustrating a means for randomly selecting indicia.

With reference to FIG. 4 a means for journalling the wheels 18*a–e* for independent rotation is illustrated with reference only to wheels 18*d,e*. Each wheel 18*d* and *e* includes a peripheral track 20 supported upon load bearings 22 which are, in turn, fixed to the pedestal 14. To maintain the planar, horizontal alignment of the wheels 18*a–e,* alignment bearings 24 are provided on spokes 26 (FIG. 1) which radiate from the axis A radially outward at the front of the display 12. Accordingly, each wheel 18*a–e* is journaled on the pedestal 14 for independent rotation relative thereto.

It is to be understood that other means could mount the wheels 18*a–e* for rotation relative to the pedestal 14 as by configuring the track to have an upstanding lip to contact alignment bearings 24 located behind the wheels 18*a–e*. It is also to be understood that other suitable means for journaling the wheels 18*a–e* to the pedestal 14 could be used.

Each wheel 18*a–e* is divided into six sectors 28*a–f*. The spokes 26, as illustrated in FIG. 1, may be arranged to delineate the sectors 28*a–f* of each of the wheels 18*a–e*. Alternatively, if the spokes 26 are dispensed with, the sectors 28*a–f* may be graphically represented on the wheels 18*a–e* as by radial lines. The delineation of the sectors 28*a–f* on the wheels 18*a–e* contributes to the symmetrical appearance of the display 12 and further, when the wheels 18*a–e* are rotated as hereinafter described, enhances the visual presentation of the rotation thereof.

Each of the wheels 18*a–e* carries at least six indicia preferable selected from playing cards. According to the preferred embodiment, each wheel 18*a–e* carries the following indicia: an Ace (A), King (K), Queen (Q), Jack (J), Ten (10) and a Wild symbol. As will hereinafter be described, the use of playing cards makes the presentation of the game familiar to players and further provides, as hereinafter described, for the application of commonly known rules of poker for the play of the game. To contribute to the symmetry of the display 12, each of the indicia is centered in a sector 28*a–f* of each of the wheels 18*a–e*.

The game, according to the presentation invention to be played with the device 10, is one in which combinations of indicia are randomly selected. According to the mechanically embodiment herein described of the device 10, the selecting means includes means for initiating the rotation of the wheels 18*a–e* to circulate the indicia about the display 12, the wheels 18*a–e* slowing to ultimately register indicia from each wheel 18*a–e* at a designated payline as an outcome combination. While the aforesaid rotation of the wheels 18*a–e* may be manually initiated by an attendant, preferable, the wheels are driven by suitable mechanical means such as hydraulic, pneumatic or as illustrated in FIG. 4, electric motors 30.

With reference to FIG. 4, rotation of each of the wheels 18*a–e* is initiated by closure of an initiator switch by a player or the attendant pressing a button which causes a processor (not shown in FIG. 4) to energize the motors 30 associated with each wheel 18*a–e*. Each motor 30 has a shaft 32 mounting a gear 34 which in turn meshes with a ring gear provided on the perimeter of track 20. Accordingly, when energized, the motors 30 initiate the rotation of each of the wheels 18*a–e* to rotate each to a predetermined or randomly selected speed. RPM sensors (not shown) provide feedback to the processor to determine the speed of the rotation of each wheel 18*a–e*. When the wheels 18*a–e* have reached their designated speed, the motors 30 are de-energized and the wheels 18*a–e* freely rotate to slow and stop registering the indicia thereon at a designated payline shown in FIG. 1 as payline 36. As stated above, the wheels 18*a–e* under the control of the processor can be brought up to random speeds and can further be randomly rotated in different directions. Still further, the wheels 18*a–e* can be serially initiated to begin the rotation of each of the wheels 18*a–e* on a time sequence to contribute to the visual presentation of the display 12. The rotation of the wheels 18*a–e* provides for the random location of indicia at the payline 36 for the play of the game as hereinafter described.

To further enhance the visual presentation of the display, means are provided to align the wheel sectors 28*a–e* to align the indicia at the payline 36 when the outcome combination has been determined. For this purpose, means are provided to sense the position of each of the wheels 18*a–e,* these means embodied as optical or electrical sensors shown in FIG. 4 as sensors 38. During rotation of the wheel 18*a–e,* the sensors 38 sense the position of each wheel 18*a–e* and generate signals to a processor corresponding to those positions. The RPM sensor or, in the alternative the signal stream from the wheel sensors 38, sense the positions of the wheels 18*a–e* when the wheels 18*a–e* stop and based thereon energize the motors 30 to move the wheels 18*a–e* either clockwise or counterclockwise to align the presentation of outcome combination at the payline 36 as shown in FIG. 1. It is to be understood that other means could be used to accomplish the final alignment. The alignment of the indicia randomly selected by the rotations of the wheels 18*a–e* at the payline 36 enhances the visual appearance of the display 12.

To designate the payline 36, the device 10 includes in ornamental header 40 which can have any suitable and pleasing design. As illustrated in FIG. 1, the header 40 may be fan shaped having radial edges to align with the wheel sectors as finally aligned with the payline. Further, the header 40 may be provided with ornamental illumination to not only clearly designate the payline 36 but to attract players to play the game.

To further contribute to the appearance of the display 12, each of the wheels 18*a–e* may be fashioned to have a transparent or semi-transparent face 42 presenting a variety of colors for each of the wheels 18*a–e* on the display 12. For this purpose, each of the faces 42 may be of a different color and backlit with lighting. Alternatively, the faces 42 may be clear with colored backlighting to produce the same effect. As can be appreciated, by providing for different colors of wheels, the colors can cascade in a spectrum simulating a rainbow. Furthermore the processor when the wheels 18*a–e* are initiated for rotation, can sequence the lighting to cascade radially inwardly or outwardly or to, for example, cascade radially at the payline 36. The lighting of the wheels 18*a–e* can be combined with lighting of the header 40 to create an attractive and exciting presentation.

Preferably, the sectors 28*a* containing the following indicia for the following wheels 18*a–e* have the following colors to simulate a rainbow and represent the outcome of a "Rainbow Royal":

| Wheel | Indicia | Color |
|---|---|---|
| 18a | Ace | Red |
| 18b | King | Orange |
| 18c | Queen | Yellow |
| 18d | Jack | Green |
| 18e | Ten | Blue |

The remainder of the sectors 28*b–f* are white or of another color. Thus when the Rainbow Royal combination aligns, the sectors 28*a* of each wheel 18*a–e* present a striking visual cascade of colors at the payline simulating the colors of a rainbow.

Turning to FIG. 3, the device 10 also includes a wagering layout embodied as a table 44 having a top 46 supported on a suitable stand 48. A ledge 50 may be provided below the top 46 for players of the game to place drinks. The top 46 has a layout 52 designating the various wagers which a player can make during play of the game. The top 46 and layout 52 may be arcuate presenting nine wagering locations or bands 54*a–i*. These wagering bands carry identification to indicate the wager being made when a wager is placed in a designated band or bands 54*a–i*. For this purpose, the bands 54*a–i*, and for play of the game herein, would bear the designations:

54*a*. Rainbow Royal (a designated sequential AKQJ10 combination)
54*b*. Five wild symbols
54*c*. Five of a kind
54*d*. Four of a kind
54*e*. Full house
54*f*. Straight
54*g*. Three of a kind
54*h*. Two pair
54*i*. One pair Thus, a player making a wager on band 54*c* designated as three of a kind, would be wagering that the randomly selected outcome combination of indicia would be a combination having three like indicia. The designations conform generally to the rules of poker. The straight designation corresponds to any straight combination (excluding the Rainbow Royal) and any straight combination using including only one Wild symbol. For example combinations of K,Q,J,10,A or Q,J,10,Wild,K would both be straights. An outcome of A,K,Wild,Wild,10 would be a pair of Wilds combination.

At the top 46, various player locations are demarcated as by lines 56 to correspond to the player locations. Where the top 46 is arcuate, the lines 56 divide the top into sectors. With continuing reference to FIG. 3, at the base of each sector, when viewing the top 46 from above, there is located a check tray 58 in which players place chips or checks for play of the game. Opposite the check trays 58 is a bank 60 where the game attendant retains chips or checks paid and received during play of the game.

To identify which outcome combination has occurred, means are provided for generating a marker in the band 54*a–i* which corresponds to the outcome. This marker generating means may be by use of a puck or similar marker by the attendant or by projecting a spot in the appropriate band 54*a–i*. Preferably, the layout 52 is transparent or semi-transparent such as being fashioned from glass or acrylic and means are provided beneath the layout 52 for lighting the band 54*a–i* corresponding the outcome combination. As with the wheels 18*a–e*, each of the bands 54*a–i* may be colored to provide a cascade of colors visually pleasing to the players or, in the alternative, the lighting below the layout 52 may include color lights to accomplish the same end. Preferably, the bands 54*a–i* are each a selected different color to somewhat correspond to the cascading color spectrum of a rainbow.

The illumination of the corresponding band 54*a–i* may be initiated by the attendant or may be automatically controlled by the game processor. In the automated embodiment, the sensors 38 identify the position of the wheels 18*a–e* and issue signals to the processor. The processor is preprogrammed to determine, based upon the signals from the sensors 38, the outcome combination. The controller in response thereto illuminates the corresponding band 54*a–i*.

To further enhance the visual presentation of the device 10, the bands 54*a–i* may flash through color sequences during the rotation of the wheels 18*a–e* prior to the display of the outcome.

The method for play of the game, according to the present invention, is for one or more players to make one or more wagers at a desired band 54*a–i*, that wager meaning that the player believes that the wagered upon combination or combinations will be selected. After all wagers have been made by players in their designated areas, the rotation of the wheels 18*a–e* is initiated. The initiation may be by the attendant or a player. The motors 30 drive the wheels 18*a–e* to rotate and thereafter are de-energized. The wheels 18*e–f* due to friction slow and register randomly selected indicia from each wheel 18*a–e* at the payline 36 as the outcome. As stated above, the wheels 18*a–e* are aligned when the outcome is selected. If the outcome corresponds to the wager made by the player, the player is paid at odds corresponding to the probabilities of that outcome. If the wagered upon outcome does not occur, the player's wager is collected.

The payoffs for winning wagers for each of the outcome can be as follows:

| Outcome | Payoff |
|---|---|
| Rainbow Royal | 7000 to 1 |
| 5 Wild symbols | 5000 to 1 |
| 5 of a kind | 1,500 to 1 |
| 4 of a kind | 50 to 1 |
| Full house | 25 to 1 |
| Straight | 10 to 1 |

-continued

| Outcome | Payoff |
|---|---|
| 3 of a kind | 3 to 1 |
| 2 pair | 2 to 1 |
| 1 pair | 1 to 1 |

To further enhance the excitement of the game, a progressive jackpot may be offered for the Rainbow Royal and five wild symbol combinations. This progressive jackpot may be funded from a portion of the wagers made by players during play of the game. A progressive meter (not shown) associated with the header 40 would display the current amount of the progressive jackpot.

Figure 5:
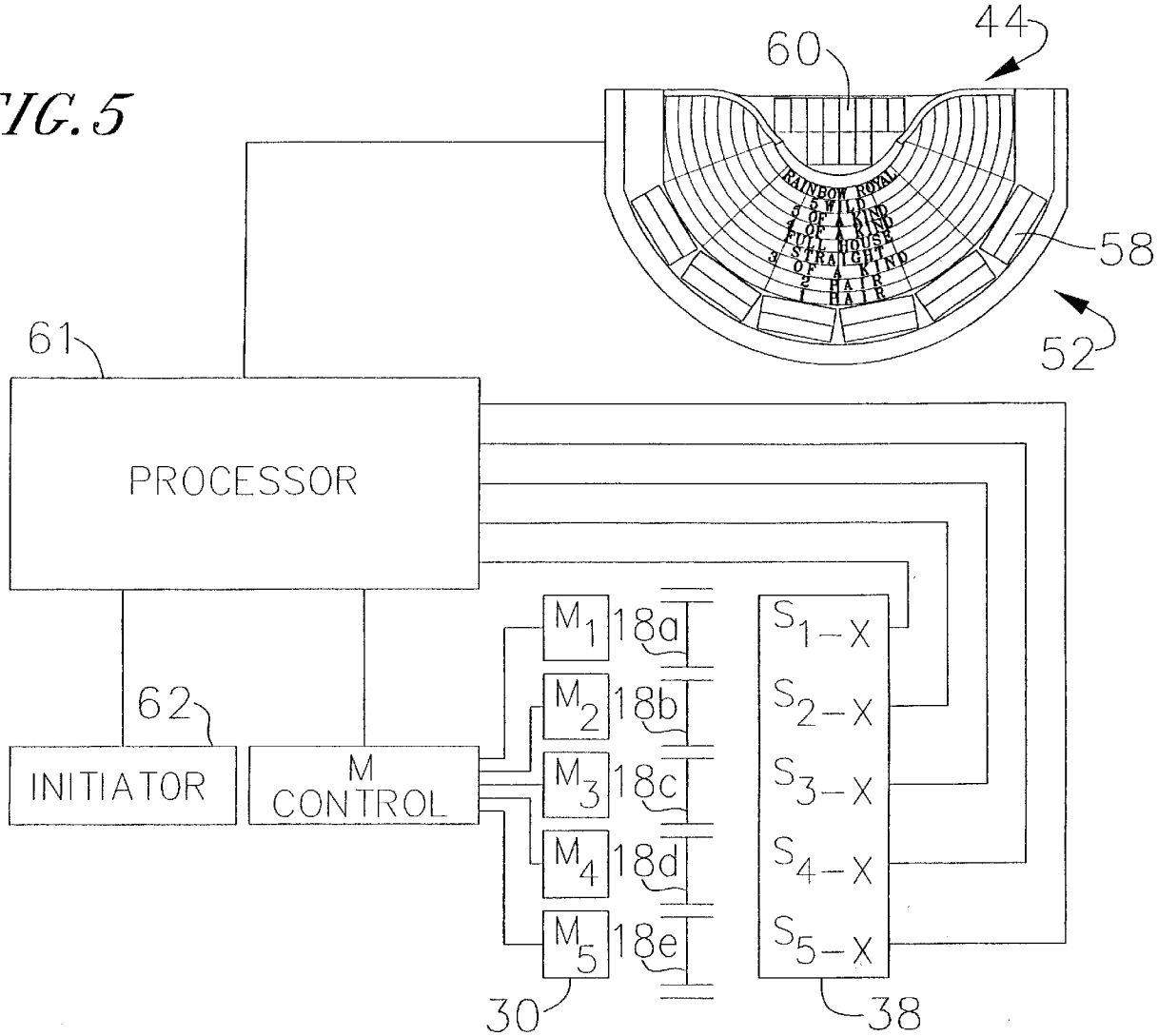
FIG. 5 is a schematic relating to the mechanical embodiment of the device according to the present invention.

With reference to FIG. 5, a further embodiment of the present invention is shown. According to this embodiment, the selection of the indicia combination is controlled by a processor 61 which randomly selects them all possible combinations. As illustrated, when the game is initiated at an initiator 62 such as the dealer or a player depressing a button, the processor 61 makes the random selection of the outcome and thereafter controls the motors 30 ($M_1$–$M_5$) to rotate the wheels 18*a–e* in an apparent random fashion for the players to see. The sensors 38 ($S_{1-x}$–$S_{5-x}$) sense the position of the wheels 18*a–e* and provide feedback to the processor 61. Based upon a controlled sequence, the wheels 18*a–e* are slowed to register the randomly selected outcome at the payline 36. As also illustrated in FIG. 5, when the selection of the outcome has registered with the payline 36, the processor 61 controls the layout 56 to illuminate the corresponding wagering band 54*a–i* in a manner described above. The use of the processor 61 to randomly select indicia combinations dispenses with any mechanical bias which may occur where the wheels 18*a–e* rotated to randomly present the indicia at the payline 36.

As a further embodiment, the display 12 may be in the form of a projection. Appropriate lighting behind transparent or semi-transparent fixed wheel faces 42 would be adapted to simulate rotation of wheels or to momentarily flash the indicia about the perimeter of each simulated wheel 18*a–e* of the display 12. A processor would randomly select the indicia combination and would thereafter enter a sequence to flash indicia or simulate rotation of wheels to ultimately align the randomly selected indicia combination at the payline 36. The projected display embodiment dispenses with the mechanical requirements of motors, wheel drives bearings and other supports.

Figure 6:
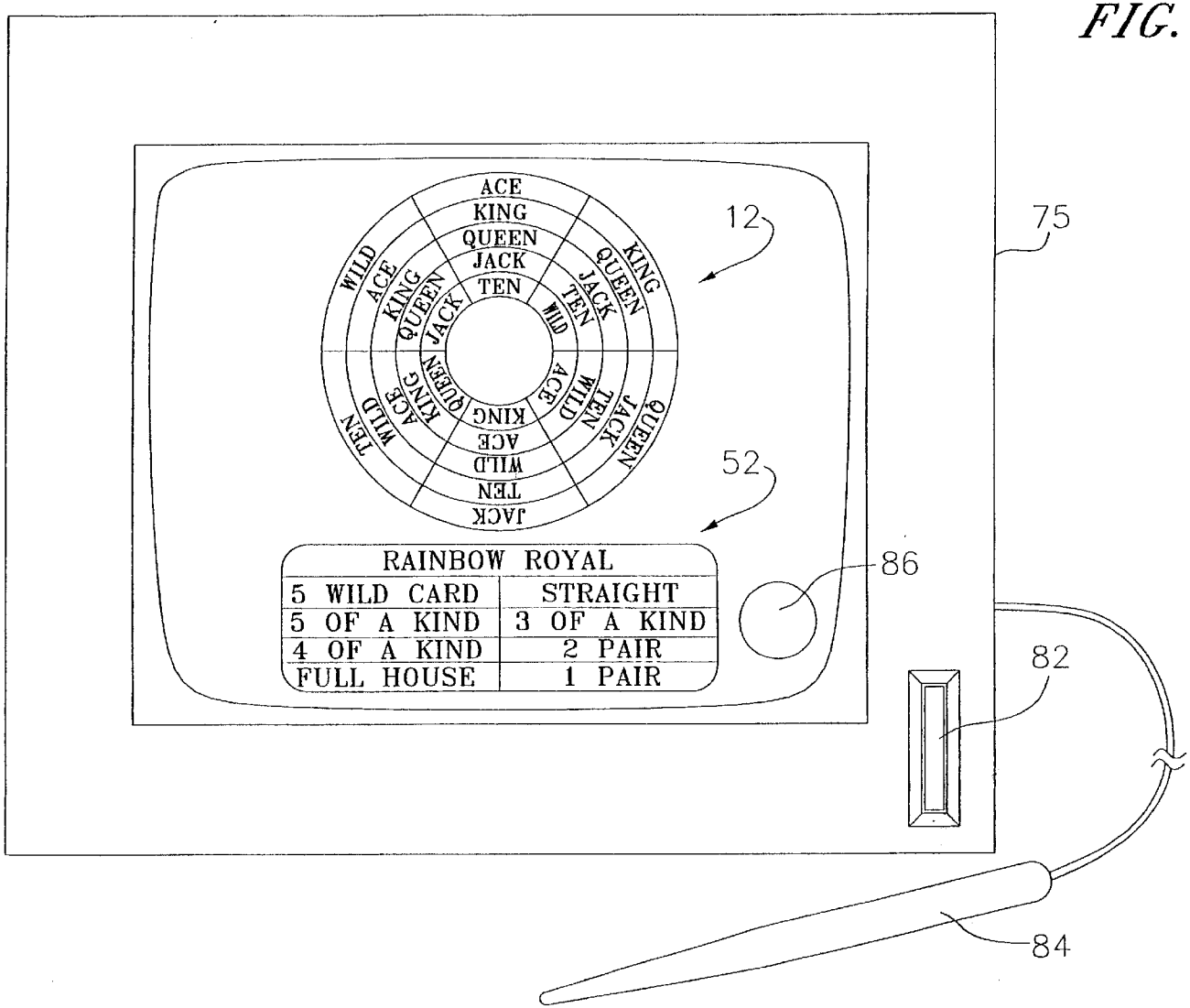
FIG. 6 illustrates a video embodiment of the game and method according to the present invention.

With reference to FIG. 6, still a further embodiment of the present invention. According to this embodiment, the display 12 is projected on a video display 75 along with the layout 52. According to this version, players would input wagers as by coins in a coin slot 82, currency or credits and would make selections of anticipated outcomes as by marking on the layout with a light pen 84 touch screen or the like. For example, a player may wager five coins on a full-house and three coins on a five of a kind. Thereafter the player would initiate a play button 86 at which time a processor would randomly select an outcome from all possible outcomes, simulate rotation of the wheels on the display and ultimately present this selected outcome. If the player wins the wager, the machine pays the player as by accumulating credits or by dispensing coins. If the wager is lost, the machine retains the wager.

To further enhance the presentation of the game, a speaker (not shown) may be provided to issue music when predetermined outcomes occur. For example for an outcome of a straight or better the processor 61 would initiate a tape player or access music digitally stored to play music at the speaker. Still further a library of songs can be stored which are randomly selected and played when the predetermined event has occurred.

As yet another variation, the motors 30 can drive rollers which frictionally engage the wheels 18*a–e* or the tracks thereof to rotate the wheels 18*a–e* in the manner described above.

As can be appreciated, the device 10 and game play method according to the present invention provides an exciting game for players to play. The rotating wheels or simulated rotation of wheels or indicia generate excitement as players anticipate that the outcome will match their wagers. The lighting of the wheels, header and layout further contributes to the excitement. As a further advantage the automated lighting of the outcome on the layout assists the attendant and players during play of the game.

As still a further version, the indicia would be placed on five cubic dice, each die having on each of its six side areas one of the following indicia; Ace, King, Queen, Jack, Ten and a Wild symbol. Furthermore the Rainbow Royal would be represented by putting a background behind or otherwise highlighting a selected Ace, King, Queen and Ten of each of five dice. For example die one would have the Ace highlighted in red, die two would have the King highlighted in orange, die three the Queen in yellow, die four the Jack in green and die five the Ten in Blue.

To play the game using die, wagers are made in the manner described above. A selected player or the dealer would then cast the five die and the display of the top, facing indicia would be the outcome. Alternatively, the dice could be mechanically thrown as by enclosing the dice in a cage or otherwise mechanically casting the dice without the players having access to the dice. Each player in turn would have the opportunity to actuate the device to cast the dice. Wagers would be resolved in the manner described above based upon the outcome.

Figure 7:
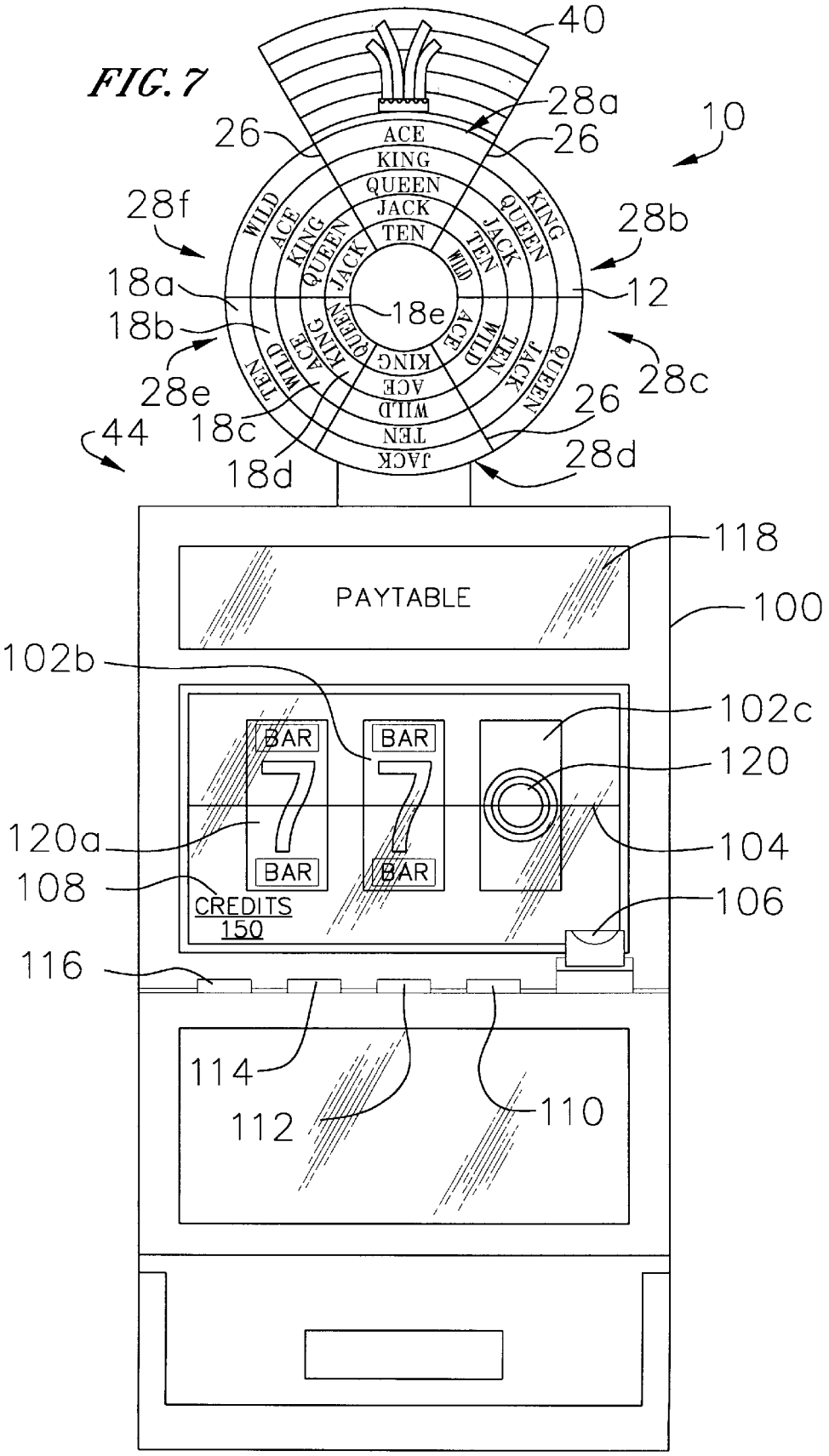
FIG. 7 shows a further embodiment where the game is provided as a secondary game to a primary game.

Turning to FIG. 7, a further embodiment of the present invention is shown. According to this embodiment a primary game device 100 is provided which may be a multi-reel, electromechanical slot machine or a video display slot machine. The primary game device 100 is of known construction and includes means for selecting primary game outcomes. For this purpose the primary game device 100 has three reels 102*a–c* each having indicia thereon such as "bar" symbols, "cherry" symbols or the like. Certain of the primary game outcomes are designated as winning outcomes with the remained designated as losing outcomes. A primary game payline is provided which, when the indicia are aligned there along, define the primary game outcome. Means such as a coin slot 106 accept wagers by the player. Additionally a cash bill acceptor may be provided to accept cash and accumulate credits available for wagering as is well known. The accumulated credits are displayed at 108.

Various buttons are provided to control wagering and the play of the primary game. Button 110 is a maximum bet button which enables the player to make a maximum wager and initiate the play of the primary game. Button 112 is a spin button to initiate the primary game when less than a maximum wager has been made. Button 114 is a bet one credit button to enable the player to wager less than the maximum and button 116 is a cashout button to enable the player to cashout whereupon the primary device dispenses the cash or token equivalent of the accumulated credits.

A paytable 118 displays the payouts to the player based upon their wager for the primary game and the secondary game as hereinafter described.

A secondary game device 10 is also provided of the type described above. Accordingly the secondary game 10 device includes the concentrically arranged wheels 18*a–e* each having the sectors 28*a–f* shown at the display 12. Each of the sectors 28*a–e* includes the representations described above. A header 40 may also be provided.

The secondary game device 10 may be of a mechanical or video version as described above.

One or more designated outcomes of the primary game device 100 are designated as bonus outcomes. As shown in FIG. 7, a bonus symbol 120 may be provided on one or all of the reels 102*a–c* which, if displayed at the payline 104 is a bonus outcome. In the event the player receives a bonus outcome during play of the primary game device 100, the secondary game is activated to rotate the wheels 18*a–e* or simulate rotation of the wheels 18*a–e* randomly select a secondary outcome in the manner described above. The secondary or bonus outcome is displayed at the payline 36 for the secondary game. Depending upon the outcome of the secondary game, the player may receive an award in addition to the award received for the outcome of the primary game, i.e. an add-on award, or a set or progressive award, or a multiplier for the award obtained in the primary game.

While we have shown and described certain embodiments to the present invention, it is to be understood that it is subject to many modifications and changes without departing from the spirit and scope of the claims presented herein.

We claim:

1. A device for playing a game of chance comprising:

a primary gaming device including means for selecting outcomes designated as losing outcomes, winning outcomes and at least one bonus outcome;

means for a player to register a wager to play the primary game to obtain one of said outcomes, said player losing the wager for losing outcomes, receiving a payoff for winning outcomes and receiving a bonus play for receiving a bonus outcome;

a secondary device including a display representing five areas;

means in each area for representing indicia of an Ace, King, Queen, Jack, Ten and a wild symbol;

means for randomly selecting an indicia from each area to display as a combination secondary outcome in response to the player receiving a bonus play outcome in the primary game, and means for rewarding the player for obtaining predetermined secondary outcomes.

2. The gaming device of claim 1 wherein said predetermined secondary outcomes include at least one of, (i) a Ace, King, Queen, Jack, and Ten combination in sequence, (ii) five wild symbols, (iii) five of a kind, (iii) four of a kind, (iv) a full house, (v) a straight, (vi) three of a kind, (vii) two pair, and (viii) a pair.

3. The device of claim 2 including a progressive jackpot, the paying means including paying the player obtaining the corresponding outcome on the secondary device approximately according to a pay schedule of, Selected Ace, King, Queen, Jack, Ten Combination
in sequence Progressive Jackpot Five wild symbols Progressive Jackpot Five of a kind 1500 to 1

Four of a kind 50 to 1

Full house 25 to 1

Straight including a 10 to 1 wild symbol

Three of a kind 3 to 1

Two pair 2 to 1

One Pair 1 to 1.

4. The device of claim 1 wherein said secondary device has five concentric areas and includes a designated payline, said random selecting means and display means cooperation to display said outcome at said payline.

5. The device of claim 4 further including means for illuminating radially aligned sectors of said areas at said payline.

6. The device of claim 4 wherein said display areas are divided into six sectors and said representing means includes intermittently representing each indicia in each sector proceeding the display of the outcome.

7. The device of claim 1 wherein the secondary device includes a display having five concentrically disposed rotatable wheels and a payline with said indicia thereon and said random selecting means includes means for initiating rotation of each of the wheels to randomly stop and register said outcome at said payline.

8. The device of claim 7 wherein each wheel has one of each indicia spaced about the wheel.

9. The device of claim 8 further including means for radially aligning the outcome indicia.

10. The device of claim 9 further including means for illuminating the outcome at the payline.

11. The device of claim 10 wherein the illuminating means is adapted to illuminate radially aligned sectors of each wheel at the payline.

12. An improved gaming device of the type including a means for accepting a wager, selecting an outcome and displaying the outcome, said outcomes designated as winning or losing outcomes, the wager won for winning outcomes and lost for losing outcomes, the improvement comprising:

a secondary game display disposed adjacent said device said display representing five concentric areas;

means in each area for representing spaced indicia of an Ace, King, Queen, Jack, Ten and a wild symbol;

means for randomly selecting an indicia from each area to display as a secondary outcome in response to the player receiving a predetermined outcome on the gaming device; and means for rewarding the player for obtaining predetermined secondary outcomes.

13. The gaming device of claim 12 wherein said predetermined secondary outcomes include at least one of, (i) a Ace, King, Queen, Jack, and Ten combination in sequence, (ii) five wild symbols, (iii) five of a kind, (iii) four of a kind, (iv) a full house, (v) a straight, (vi) three of a kind, (vii) two pair, and (viii) a pair.

14. The device of claim 12 wherein said secondary display includes a designated payline, said random selecting means and display means cooperating to display said outcome at said payline.

15. The device of claim 14 further including means for illuminating radially aligned sectors of said areas at said payline.

16. The device of claim 12 wherein said display areas are divided into six sectors and said representing means includes intermittently representing each indicia in each sector proceeding the display of the outcome.

17. The device of claim 12 including a progressive jackpot, the paying means including paying the player obtaining the corresponding outcome on the secondary device approximately according to a pay schedule of, Selected Ace, King, Queen, Jack, Ten Combination Progressive Jackpot in sequence Five Wild symbols Progressive Jackpot Five of a Kind 1500 to 1

Four of a Kind 50 to 1

Full house 25 to 1

Straight including a 10 to 1

Wild symbol

Three of a Kind 3 to 1

Two Pair 2 to 1

One Pair 1 to 1.

18. The device of claim 12 wherein the secondary display includes a display having five concentrically disposed rotatable wheels and a payline with said indicia thereon and said random selecting means includes means for initiating rotation of each of the wheels to randomly stop and register said outcome at said payline.

19. The device of claim 18 wherein each wheel has one of each indicia spaced about the wheel.

20. The device of claim 19 further including means for radially aligning the outcome indicia.

21. The device of claim 20 further including means for illuminating the outcome at the payline.

22. The device of claim 21 wherein the illuminating means is adapted to illuminate radially aligned sectors of each wheel at the payline.

23. A method for playing a game using selected playing cards comprising:

providing a primary game adapted to accepting a wager, and randomly display a primary game outcome, selected outcomes designated as winning outcomes and other designated as winning losing outcomes;

providing a secondary game display having five concentric areas, each area having an indicia of an Ace, King, Queen, Jack, Ten and a Wild symbol;

randomly selecting an indicia from each area as a secondary outcome in response to a preselected primary game outcome;

rewarding the player an additional amount in response to obtaining a preselected secondary.

24. The method of claim 23 including rewarding the player for obtaining one of the following secondary outcomes (i) a selected Ace, King, Queen, Jack, and Ten combination in sequence, (ii) five wild symbols, (iii) five of a kind, (iii) four of a kind, (iv) a full house, (v) a straight, (vi) three of a kind, (vii) two pair, and (viii) a pair.

* * * * *